US009281555B2

(12) United States Patent
Jeuland

(10) Patent No.: US 9,281,555 B2
(45) Date of Patent: Mar. 8, 2016

(54) METHOD AND MONOPOLE ANTENNA FOR MAKING UNIFORM THE RADIATION OF SAID ANTENNA, WHEN DISPOSED INSIDE A RADOME

(71) Applicants: AIRBUS OPERATIONS (S.A.S.), Toulouse (FR); ONERA (Office national d'études et de recherches aérospatiales), Châtillon (FR)

(72) Inventor: Hervé Jeuland, Lacroix-Falgarde (FR)

(73) Assignees: Airbus Operations (S.A.S.), Toulouse (FR); ONERA (Office national d'études et de recherches aérospatiales), Châtillon (FR)

( * ) Notice: Subject to any disclaimer, the term of this patent is extended or adjusted under 35 U.S.C. 154(b) by 128 days.

(21) Appl. No.: 14/186,737

(22) Filed: Feb. 21, 2014

(65) Prior Publication Data

US 2014/0240192 A1 Aug. 28, 2014

(30) Foreign Application Priority Data

Feb. 22, 2013 (FR) ..... 13 51546

(51) Int. Cl.
*H01Q 1/36* (2006.01)
*H01Q 1/42* (2006.01)
*H01Q 9/40* (2006.01)

(52) U.S. Cl.
CPC ..... *H01Q 1/36* (2013.01); *H01Q 1/421* (2013.01); *H01Q 9/40* (2013.01); *Y10T 29/49016* (2015.01)

(58) Field of Classification Search
CPC ..... H01Q 1/02; H01Q 1/27; H01Q 1/28; H01Q 1/36; H01Q 1/38; H01Q 1/40; H01Q 1/42; H01Q 1/242; H01Q 1/246; H01Q 9/32; H01Q 9/36; H01Q 9/40; H01Q 9/42; H01Q 21/28; H01Q 21/30; H01Q 5/364
USPC ..... 343/872, 753, 846, 853, 850, 893, 343/700 MS, 860, 848, 705
See application file for complete search history.

(56) References Cited

U.S. PATENT DOCUMENTS 5,191,349 A * 3/1993 Dinsmore ..... H01Q 1/28 343/751
6,198,449 B1 * 3/2001 Muhlhauser ..... H01Q 3/2658 343/753

(Continued)

FOREIGN PATENT DOCUMENTS

EP 1 542 314 A1 6/2005

OTHER PUBLICATIONS

Blume, S. et al. "Biconical antennas and conical horns with elliptic cross section", IEEE Transactions on Antennas and Propagation, IEEE Service Center, Piscataway, NJ, US, 36, 8. Dated Aug. 1, 1988.

(Continued)

*Primary Examiner* — Lam T Mai
(74) *Attorney, Agent, or Firm* — Jenkins, Wilson, Taylor & Hunt, P.A.

(57) ABSTRACT

Method and monopole antenna for making uniform the radiation of the antenna, when disposed inside a radome. According to the invention, on the surface of the monopole antenna is formed a protruding longitudinal ridge which is disposed at least approximately opposite an area of the radiating pattern of the assembly radome (1)-monopole antenna having a reduced gain in comparison with the radiating pattern of said monopole antenna alone.

12 Claims, 4 Drawing Sheets

(56) References Cited

U.S. PATENT DOCUMENTS

| | | | | |
|---|---|---|---|---|
| 6,219,007 | B1 * | 4/2001 | Kline | H01Q 1/24 343/702 |
| 6,313,783 | B1 * | 11/2001 | Kuntman | G01S 13/76 342/29 |
| 6,313,801 | B1 * | 11/2001 | Sanford | H01Q 1/242 343/700 MS |
| 7,006,047 | B2 | 2/2006 | Marsan | |
| 7,116,278 | B2 | 10/2006 | Marsan | |
| 8,159,403 | B1 * | 4/2012 | Chen | H01Q 1/281 343/705 |
| 2002/0154067 | A1 | 10/2002 | Gilbert | |
| 2005/0122274 | A1 | 6/2005 | Marsan | |

OTHER PUBLICATIONS

French Search Report for Application No. 1351546 dated Jan. 14, 2014.

* cited by examiner

METHOD AND MONOPOLE ANTENNA FOR MAKING UNIFORM THE RADIATION OF SAID ANTENNA, WHEN DISPOSED INSIDE A RADOME

TECHNICAL FIELD

The present invention relates to microwave monopole antennas, positioned inside a radome.

BACKGROUND

Known microwave monopole antennas have a surface of revolution that is, for example, cylindrical or conical and it is known that, over their whole bandwidth, they have an omnidirectional radiation pattern that is uniform in a plane orthogonal to their axis.

It is also known, as shown for example by the prior documents U.S. Pat. Nos. 7,006,047 and 7,116,278, that such omnidirectional antennas can be mounted on a ground plane constituted by the outer surface of a carrier vehicle, such as an aircraft, for example for the purposes of communication or detection of radar. To protect said antennas, each of them is surrounded by a cylindrical radome coaxial thereto. Because of its cylindrical shape and its coaxial mounting, such a radome does not disturb the omnidirectional uniformity of the radiation pattern of the antenna/radome assembly thus produced.

Such a known antenna/radome assembly does, however, have the drawback that the cylindrical radome is positioned orthogonal to the airflow around said vehicle, so that it generates high aerodynamic drag.

To avoid this drawback, said radome could conceivably be given a profiled aerodynamic shape; but in that case such a shape (by definition not produced by revolution about the axis of the antenna) and also the structure of the radome (the permittivity of which is generally greater than 1 for reasons of mechanical resistance) would entail the disappearance of the uniformity of the omnidirectional radiation pattern of the profiled antenna/radome assembly, with varying degrees of deformation depending on frequency and direction, which could lead to very negative values for gain (expressed in decibels isotropic) at certain points of said radiation pattern.

The subject-matter of the present invention is to remedy this drawback by making it possible to produce such an antenna/radome assembly having both uniform omnidirectional radiation and low aerodynamic drag.

To this end, according to the invention, the method for ensuring a uniform radiation pattern of an assembly comprising:

- a monopole antenna having a surface of revolution, and
- a radome with an aerodynamic profile, inside which said monopole antenna is positioned, is remarkable in that it comprises the following steps:

- determining the radiation pattern of said antenna/radome assembly;
- determining the directions, about the axis of revolution of said monopole antenna positioned inside said radome, wherein said radiation pattern of the antenna/radome assembly has areas in which the gain values are reduced in comparison with the radiation pattern of said monopole antenna; and
- modifying the surface of revolution of said monopole antenna, to form on it a protruding longitudinal ridge that is at least approximately facing at least one of said areas of reduced gain thus determined.

Indeed, the applicants have found that such ridges made it possible to reorientate, in the directions in which they face, the waves of the antenna that are disturbed by the presence of the radome, and therefore to combat the formation of areas of the radiation pattern with reduced, or even negative, gain values.

Thus, thanks to the present invention, said antenna/radome assembly has low aerodynamic drag, because of the profiling of said radome, and an omnidirectional radiation that is at least approximately uniform, because said ridges constitute areas of electromagnetic diffraction that make it possible to control the radiation of the antenna provided with said aerodynamic radome.

According to the invention, an assembly comprising:

- a monopole antenna having a surface of revolution; and
- a radome with an aerodynamic profile, inside which said monopole antenna is positioned, the radiation pattern of said antenna/radome assembly having areas in which the gain values are reduced in comparison with the radiation pattern of said monopole antenna, is remarkable in that said monopole antenna comprises, on its surface of revolution, at least one protruding longitudinal ridge positioned at least approximately facing at least one of said areas of reduced gain.

In a preferred embodiment of said antenna/radome assembly according to the present invention:

- said radome is a hollow body with an aerodynamic profile comprising two opposite side walls connected at their ends by a leading edge and by a trailing edge that define a median longitudinal plane for said radome,
- the axis of said antenna is located at the intersection of the median longitudinal plane and the median transverse plane of said radome, and
- the surface of said antenna comprises, transverse to said median longitudinal plane of said radome and on either side of said plane, two longitudinal ridges positioned respectively directly facing the corresponding side wall of said radome.

In an advantageous embodiment, on either side of each of said longitudinal ridges, positioned directly facing the side walls of the radome, the surface of said monopole antenna comprises two longitudinal ridges obliquely facing the corresponding side wall of the radome. Preferably, said longitudinal ridges positioned directly facing the side walls of the radome and said longitudinal ridges positioned obliquely facing said side walls are portions of ellipses. In this case, all of said longitudinal ridges can belong to three ellipses centered on the axis of said antenna, the minor axes, major axes and relative orientations of which form parameters so as to optimize a uniform radiation pattern of said monopole antenna/radome assembly.

In a variant, on either side of the median longitudinal plane of the radome, the longitudinal ridge positioned directly facing the corresponding side wall of the radome and the two associated longitudinal ridges positioned obliquely facing the latter side wall can merge to form a single, rounded lateral projection. In this case the surface of said antenna has a rounded groove facing said leading edge and said trailing edge of the radome.

In order to reduce the effects of diffraction generated by the open end of said monopole antenna, said end is advantageously closed by a plug. Such a plug may have different forms, for example that of a cap.

Furthermore, to reduce the lateral dimensions of the antenna, it may be advantageous for said monopole antenna to be positioned inside a hollow shape made of a dielectric material, for example of ceramic type, which takes on the shape thereof and the permittivity of which results from a compromise between the lateral reduction of said antenna and the bandwidth of said antenna.

In one exemplary embodiment, the monopole antenna is made of brass, the permittivity of the material constituting the radome (for example, a composite material of FR-4 type) is of the order of 4, and the permittivity of the material constituting said hollow cylinder is of the order of 5.

Preferably, in order to secure said monopole antenna to said radome, the radome is filled with a foam of low permittivity (for example of the order of 1) confining said monopole antenna.

The present invention can be implemented both for generally conical-shaped monopole antennas with a wide bandwidth and for generally cylindrical-shaped monopole antennas with a narrow bandwidth. However, the following refers mainly to a generally conical-shaped monopole antenna.

The figures in the appended drawings will make it easier to understand how the invention can be implemented. In these figures, identical references denote similar elements.

Figure 1:
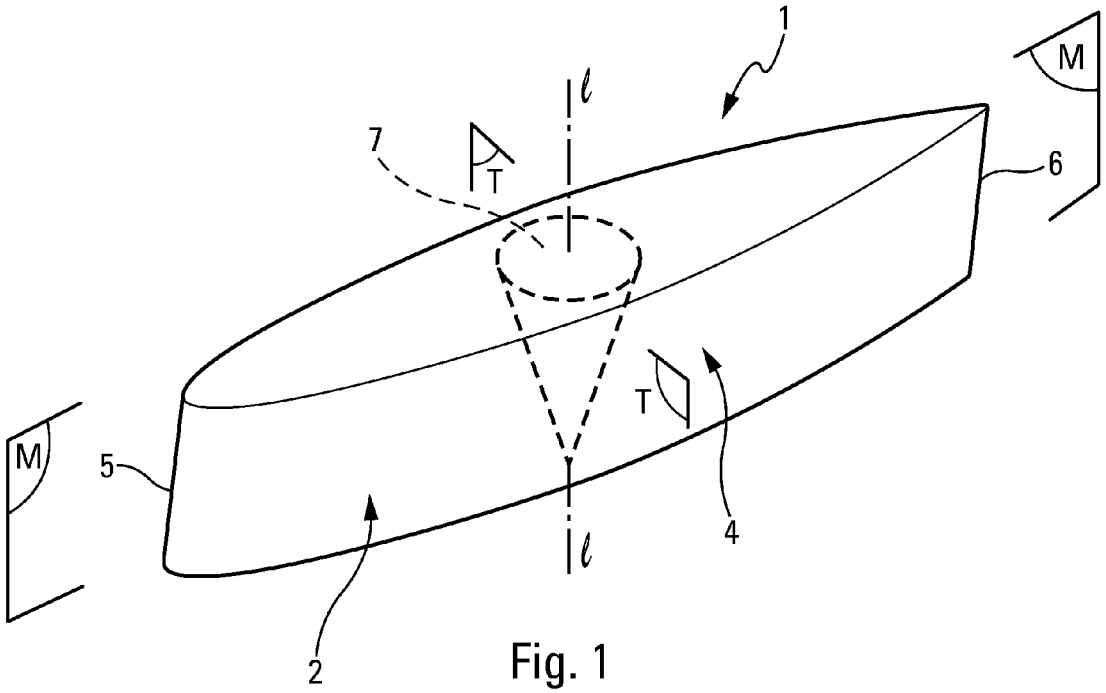
FIG. 1 shows, in diagrammatic perspective, an aerodynamically shaped radome enclosing a known conical monopole antenna.

The radome 1, illustrated in FIGS. 1, 2, 5 and 9, is made of a resin-type composite material loaded with dielectric fibres of permittivity close to 4, for example a composite material of FR-4 (flame-resistant 4) type.

The radome 1 has the form of a hollow body with an aerodynamic profile 2, comprising two opposite side walls 3 and 4, connected at their ends by a leading edge 5 and by a trailing edge 6. The leading edge 5 and the trailing edge 6 define a median longitudinal plane with symmetry M for said radome, containing the longitudinal axis X-X thereof.

Figure 2:
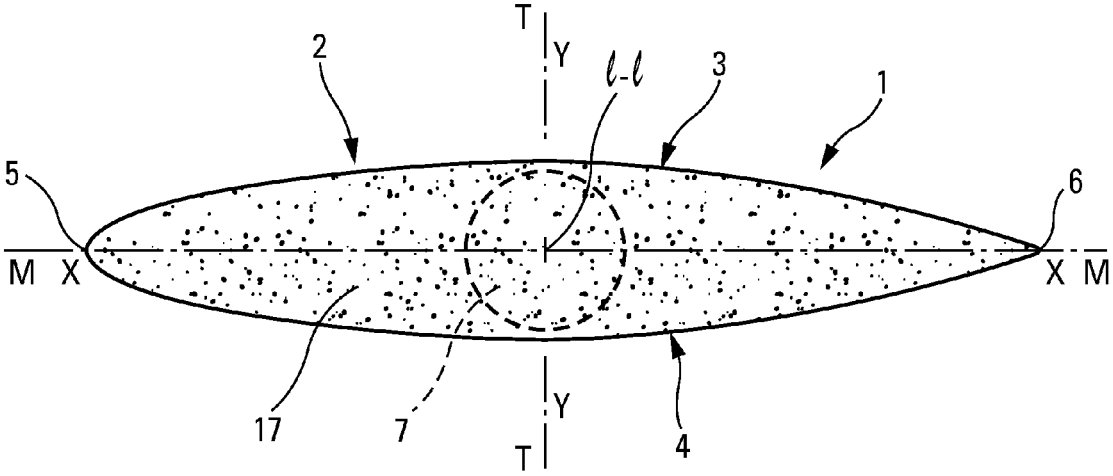
FIG. 2 is a plan view of FIG. 1.

Inside the radome 1 of FIGS. 1 and 2 has been positioned a conical microwave monopole antenna 7, for example made of brass, capable of working in the 0.7 GHz to 6 GHz frequency band and the longitudinal axis l-l of which is in the median longitudinal plane M of the radome 1 and oriented perpendicular to the ground plane. The plane T, passing through the axis l-l of the antenna 7 and orthogonal to the median longitudinal plane M, defines a transverse axis Y-Y, perpendicular to the longitudinal axis X-X.

Thus, the axes X-X and Y-Y form a rectangular reference positioning mark about the longitudinal axis l-l of the monopole antenna 7. In the diagrams in FIGS. 3, 6 and 10, the axis X-X corresponds to the orientation 0°-180°, while the axis Y-Y corresponds to the orientation 90°-270°.

Figure 3:
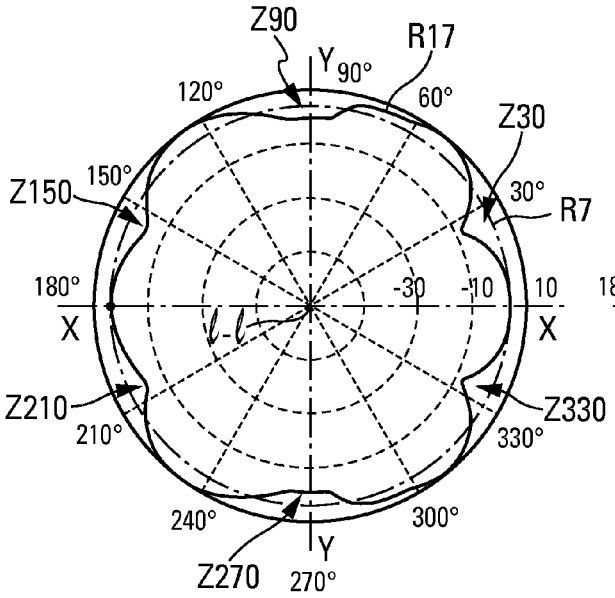
FIG. 3 shows the radiation pattern in dB and at 5 Hz of the radome/monopole antenna assembly of FIGS. 1 and 2, in comparison with the radiation pattern of the single known conical monopole antenna.
Figure 6:
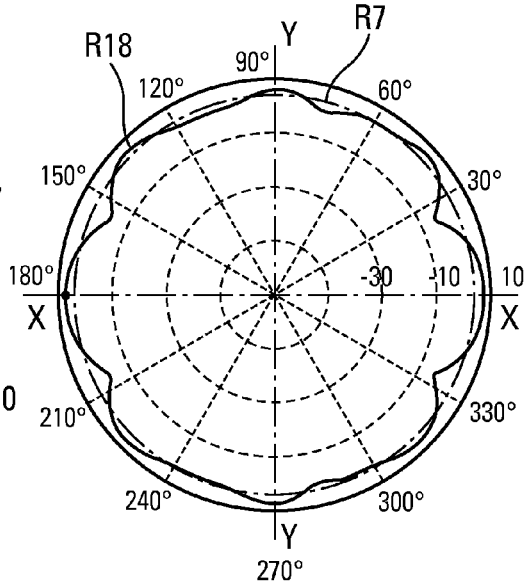
FIG. 6 shows the radiation pattern in dB and at 5 Hz of the radome/monopole antenna assembly of FIG. 5, in comparison with the radiation pattern of the single known conical monopole antenna.
Figure 10:
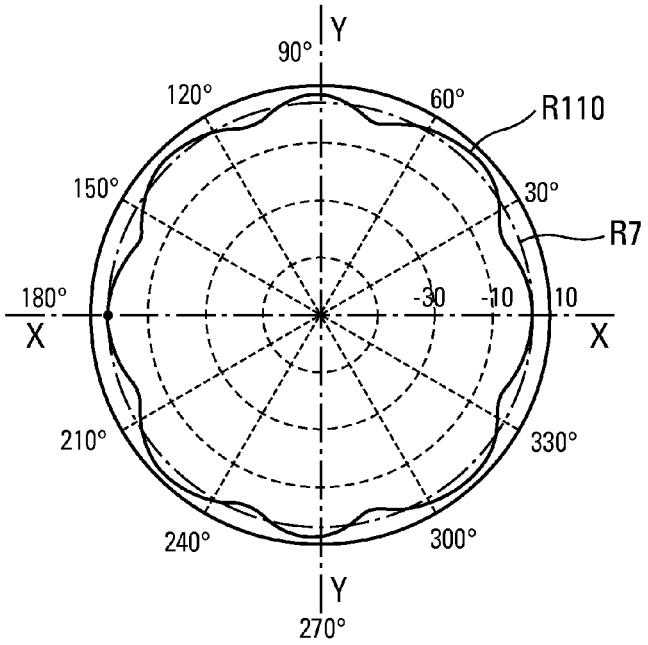
FIG. 10 shows the radiation pattern in dB and at 5 Hz of the radome/monopole antenna assembly of FIG. 9, in comparison with the radiation pattern of the single known conical monopole antenna.

In a known manner, when the monopole antenna 7 is not positioned inside the radome 1, its radiation pattern R7 is uniformly omnidirectional and its gain values are positive in all directions (see FIGS. 3, 6 and 10).

In contrast, in the configuration in FIGS. 1 and 2, for which the monopole antenna 7 is positioned inside the radome 1, the radiation pattern R17 of the radome 1/monopole antenna 7 assembly has considerable direction-dependent fluctuations (see FIG. 3). Indeed, the field radiated by the radome 1/monopole antenna 7 assembly depends on the distribution of electrical and magnetic fields over the faces of the radome 7, these fields depending on the coefficients of reflection and transmission of the walls of said radome, which themselves depend on the angle of incidence of the waves on the faces of the radome. As can be seen in FIG. 3, the radiation pattern R17 at 5 GHz can have deviations of gain of +/−10 dB around the mean value, some values for gain even being negative (close to −10 dB).

To remedy these drawbacks and produce a radome 1/monopole antenna assembly having a substantially uniform omnidirectional radiation pattern, the invention consists, for an aerodynamic radome of given form and permittivity and, preferably, while preserving the outer shell of said antenna 7, in optimizing the contour of the section of the monopole antenna by forming convex areas (projecting ridges) and, consequently, concave areas (grooves) on its surface, constituting areas of electromagnetic diffraction that, by electromagnetic coupling with the aerodynamic radome 1, are capable of allowing such an omnidirectional, at least substantially uniform, radiation pattern to be produced. Thus, the number, distribution and size of said projecting ridges constitute parameters which make it possible to control the diffraction of the electromagnetic waves over the surface of the monopole antenna and, therefore, the radiation of the assembly formed by the aerodynamic radome 1 and the monopole antenna. The invention is based on the fact that, in the first instance, a ridge focuses energy in the direction in which it is facing.

Thus, referring to FIG. 3, it will be noted that the radiation pattern R17 of the assembly formed by the radome 1 and the monopole antenna 7 has, in comparison with the radiation pattern R7 of the antenna 7 on its own, areas with gain values that are reduced, and sometimes even negative, at least approximately in the directions 30°-210°, 90°-270° and 150°-330°. These areas of reduced gain are given the references Z30, Z90, Z150, Z210, Z270 and Z330 respectively.

In accordance with the present invention, to fill at least some of these areas Z30, Z90, Z150, Z210, Z270 and Z330, projecting longitudinal ridges at least approximately facing said areas are provided on the surface of antenna of the invention.

Figure 4B:
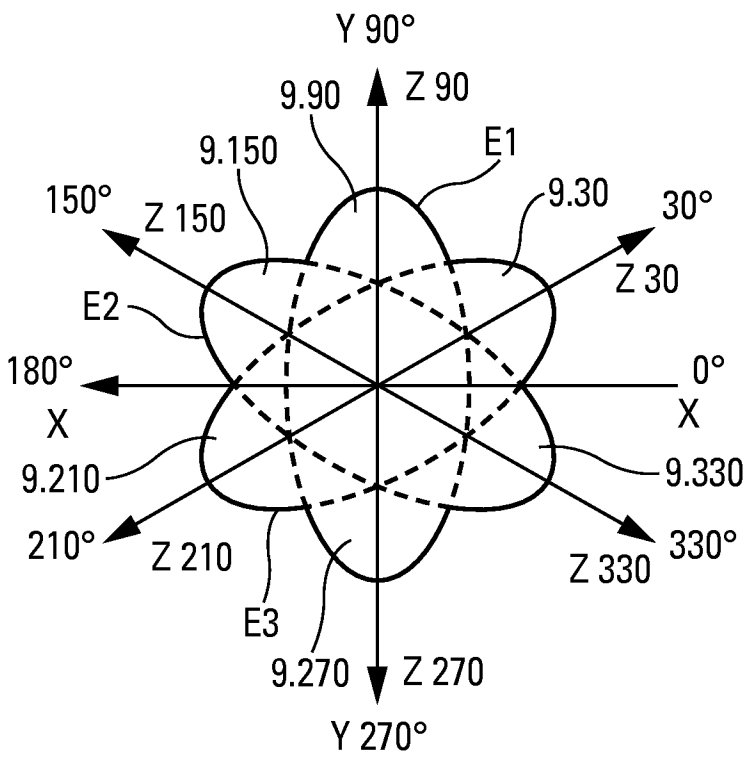
FIG. 4B illustrates how the section in FIG. 4A can be produced.
Figure 4A:
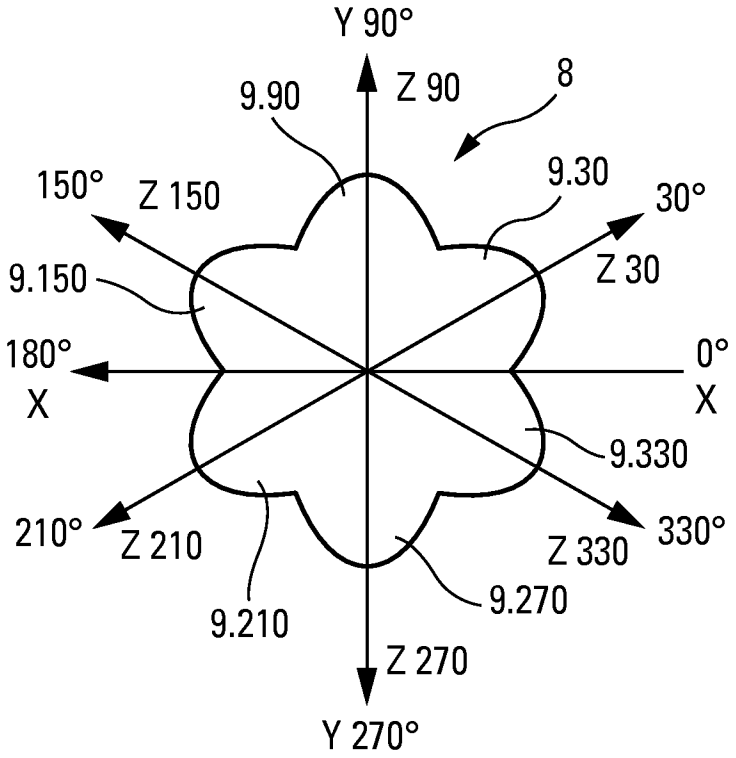
FIG. 4A shows the section of a monopole antenna according to the present invention.
Figure 5:
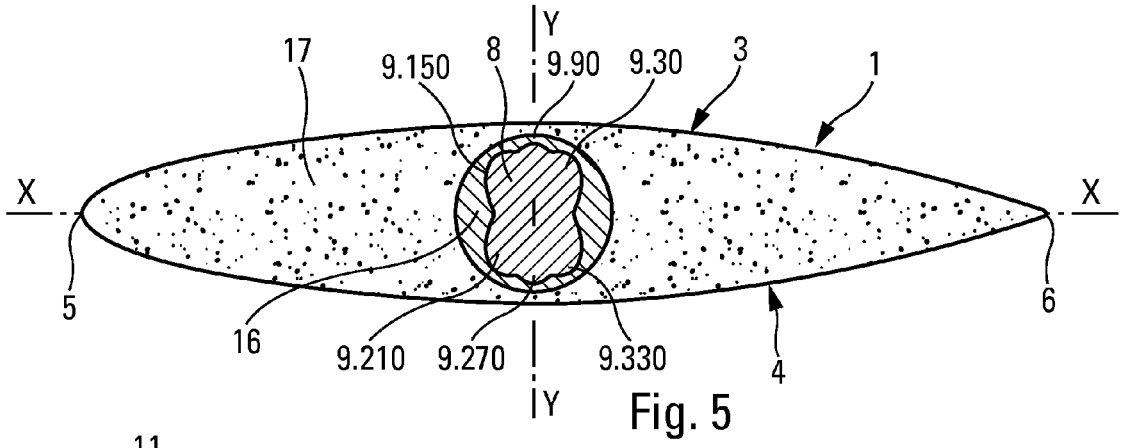
FIG. 5 shows, in a cut-away view, the positioning inside the radome of the monopole antenna of FIG. 4A according to the present invention.

A monopole antenna 8 of this kind, according to the present invention, is illustrated in FIG. 4A, which shows that the surface of said monopole antenna 8 comprises projecting longitudinal ridges 9.30, 9.90, 9.150, 9.210, 9.270 et 9.330, respectively in the directions 30°, 90°, 150°, 210°, 270° and 330°, i.e. at least approximately facing said areas Z30, Z90, Z150, Z210, Z270 and Z330, when the monopole antenna 8 is positioned inside the radome 1, as illustrated diagrammatically by FIG. 5. Thus, the ridges 9.90 and 9.270 are positioned respectively directly facing the side walls 3 and 4 of the radome 1, while the ridges 9.30 and 9.150, 9.210 and 9.330 are positioned obliquely facing said side walls 3 and 4.

As illustrated in FIG. 4B, the ridges 9.30, 9.90, 9.150, 9.210, 9.270 and 9.330 can have the shape of portions of three ellipses, these ellipses E1, E2 and E3 being coaxial. FIG. 4B illustrates identical ellipses E1, E2 and E3, but obviously they can be different, as shown in FIG. 5. It will readily be understood that the size of the ellipses E1, E2, E3 (defined by the major axis and the minor axis thereof), as well as the inclination of their axes relative to the longitudinal axis X-X of the radome 1, are parameters that make it possible to optimize a uniform radiation pattern R18 of the monopole antenna 8/radome 1 assembly.

In FIG. 6 the radiation pattern R18 at 5 GHz has been drawn, and it can be seen that the areas Z90 and Z270 have been removed, that the areas Z30, Z150, Z210, and Z330 have been reduced and that the gain has been improved in the direction of the axis X-X. At most, the radiation pattern R18 has residual deviations of gain of +/−4 dB around the mean value, the minimum value for gain being −3 dB.

To optimize even further the radiation pattern of the monopole antenna/radome assembly, use can be made of a known antenna design tool including an optimization module (for example implementing an optimization algorithm such as the Newton method), in which the antenna and its radome are described by a geometric model, of CAD type.

Figure 7:
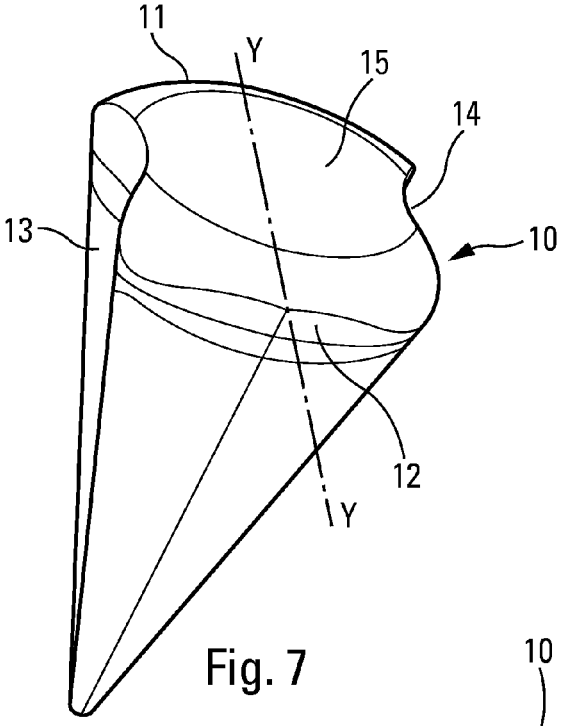
FIG. 7 shows, in perspective, a variant embodiment of the monopole antenna according to the present invention.
Figure 8:
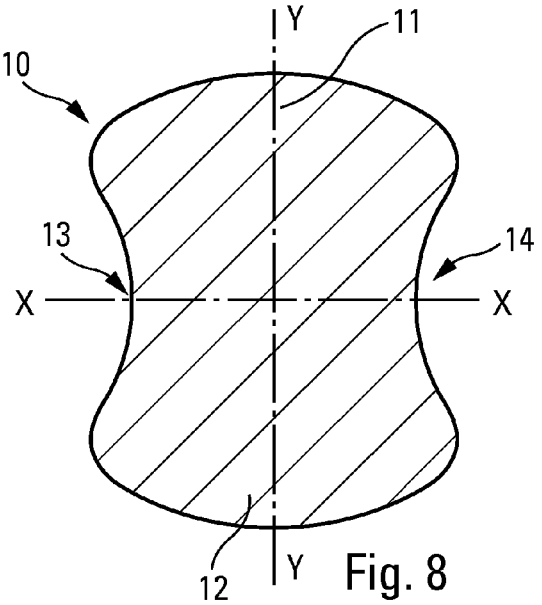
FIG. 8 shows an enlarged section of the monopole antenna of FIG. 7.
Figure 9:
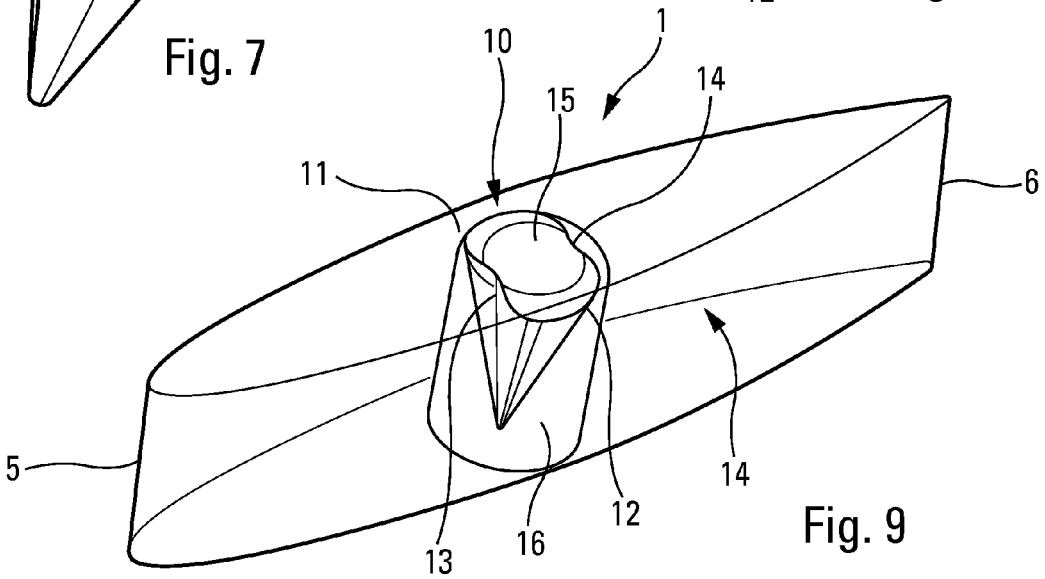
FIG. 9 illustrates the positioning of the monopole antenna of FIG. 7 inside the radome, assuming that the latter is at least substantially transparent to the waves from the monopole antenna.

It is then possible to produce an improved monopole antenna, such as the antenna 10 illustrated in FIGS. 7, 8 and 9. In this monopole antenna 10 according to the present invention, each of the longitudinal ridges 9.90 and 9.270, positioned directly facing the side walls 3 and 4 of the radome 1 is merged with the two associated longitudinal ridges (9.30 and 9.150 for the ridge 9.90, and 9.210 and 9.330 for the ridge 9.270) positioned obliquely facing them, to form a single, rounded lateral projection 11 or 12 respectively. In this way the surface of the monopole antenna 10 has a rounded groove 13 or 14, respectively facing the leading edge 5 and facing the trailing edge 6 of the radome 1.

The radiation pattern R110 at 5 GHz of the assembly formed by the radome 1 and the monopole antenna 10 is illustrated in FIG. 10. As can be seen, the deviations of residual gain are at most +/−2 dB around the mean value, the minimum value for gain being −1 dB.

As shown by FIGS. 7 and 9, the open end of the monopole antenna 10 is advantageously closed by a plug 15.

Moreover, the monopole antenna 8 (FIG. 5) and the monopole antenna 10 (FIG. 9) can be positioned inside a hollow cylinder 16 made of a dielectric material that takes on the shape of said antennas and the permittivity of which results from a compromise between a lateral reduction of said antenna and the bandwidth of said antenna. These monopole antennas 8 and 10, according to the present invention, are preferably secured to the radome 1 by a foam 17, of permittivity close to 1, filling said radome 1 (FIGS. 2 and 5).

Although these figures illustrate generally conical-shaped monopole antennas, it goes without saying that the present invention also relates to generally cylindrical-shaped monopole antennas.

The invention claimed is:

1. A method for ensuring a uniform radiation pattern of an assembly comprising:

a monopole antenna, and a radome with an aerodynamic profile, inside which said monopole antenna is positioned, wherein the method comprises:

determining the radiation pattern of said antenna/radome assembly;

determining the directions, about the axis of said monopole antenna positioned inside said radome, in which said radiation pattern of the antenna/radome assembly has areas in which the gain values are reduced in comparison with the radiation pattern of said monopole antenna; and modifying the surface of said monopole antenna, to form on it a protruding longitudinal ridge that is at least approximately facing at least one of said areas of reduced gain thus determined.

2. An assembly comprising:

a monopole antenna having a surface of revolution, and a radome with an aerodynamic profile optimized to reduce aerodynamic drag in at least one direction of travel, inside which the monopole antenna is positioned, the radome creating areas of reduced gain of the monopole antenna, wherein the monopole antenna comprises, on the surface of revolution, at least one protruding longitudinal ridge positioned at least approximately facing at least one of the areas of reduced gain.

3. The assembly according to claim 2, wherein:

the radome comprises a hollow body comprising two opposite side walls connected at their respective ends by a leading edge and by a trailing edge that define a median longitudinal plane for the radome, an axis of the monopole antenna is located at an intersection of the median longitudinal plane and a median transverse plane orthogonal to the median longitudinal plane of the radome, and the surface of the monopole antenna comprises, transverse to the median longitudinal plane of the radome and on either side of the plane, two longitudinal ridges positioned respectively directly facing a corresponding side wall of the radome.

4. The assembly according to claim 3, wherein, on either side of each of the longitudinal ridges positioned directly facing the side walls of the radome, the surface of the monopole antenna comprises two longitudinal ridges obliquely facing the corresponding side wall of the radome.

5. The assembly according to claim 4, wherein the longitudinal ridges positioned directly facing the side walls of the radome and the longitudinal ridges positioned obliquely facing the side walls comprise portions of ellipses.

6. The assembly according to claim 5, wherein the longitudinal ridges comprise three ellipses centered around the axis of the monopole antenna, minor axes, major axes and relative orientations of which form parameters to optimize a uniform radiation pattern of the monopole antenna/radome assembly.

7. The assembly according to claim 4, wherein, on either side of the median longitudinal plane of the radome, the longitudinal ridge positioned directly facing the corresponding side wall of the radome and the two associated longitudinal ridges positioned obliquely facing the latter side wall merge to form a single rounded lateral projection.

8. The assembly according to claim 7, wherein the surface of the monopole antenna has a rounded groove which faces the leading edge and the trailing edge of the radome.

9. The assembly according to claim 2, wherein the monopole antenna has at least one open end which is closed by a plug.

10. The assembly according to claim 2, wherein the monopole antenna has a shape and is positioned inside a hollow form of dielectric material taking on the shape of the monopole antenna.

11. The assembly according to claim 2, wherein the radome is filled with foam of a permittivity close to 1, confining the monopole antenna and securing the monopole antenna to the radome.

12. A monopole antenna having a surface of revolution and for positioning inside a radome with an aerodynamic profile optimized to reduce aerodynamic drag in at least one direction of travel to form an antenna/radome assembly, a radiation pattern of the antenna/radome assembly having areas in which gain values are reduced in comparison with a radiation pattern of the monopole antenna alone, wherein the monopole antenna comprises, on the surface of revolution, at least one protruding longitudinal ridge for facing, at least approximately, at least one of the areas of reduced gain of the monopole antenna positioned inside the radome.

* * * * *